US005875975A

United States Patent [19]

Reiter et al.

[11] Patent Number: 5,875,975

[45] Date of Patent: Mar. 2, 1999

[54] FUEL INJECTOR

[75] Inventors: Ferdinand Reiter; Assadollah Awarzamani, both of Markgröningen, Germany

[73] Assignee: Robert Bosch GmbH, Stuttgart, Germany

[21] Appl. No.: 836,271

[22] PCT Filed: Jun. 19, 1996

[86] PCT No.: PCT/DE96/01078

§ 371 Date: Apr. 30, 1997

§ 102(e) Date: Apr. 30, 1997

[87] PCT Pub. No.: WO97/09528

PCT Pub. Date: Mar. 13, 1997

[30] Foreign Application Priority Data

Sep. 6, 1995 [DE] Germany ..... 195 32 865.5

[51] Int. Cl.[6] ..... B05B 1/30

[52] U.S. Cl. ..... 239/585.1; 239/533.3; 239/585.4; 239/900; 29/890.124; 251/129.21

[58] Field of Search ..... 251/129.21; 29/890.124; 239/533.1, 533.2, 533.3, 533.4, 533.6, 533.9, 585.1, 585.4, 900

[56] References Cited

U.S. PATENT DOCUMENTS

| | | | |
|---|---|---|---|
| 4,483,485 | 11/1984 | Kamiya et al. | 251/129.21 X |
| 4,648,559 | 3/1987 | Fuller | 239/585.1 |
| 4,759,331 | 7/1988 | Sausner | 239/585.4 X |
| 4,790,351 | 12/1988 | Kervagoret | 251/129.21 X |
| 4,944,486 | 7/1990 | Babitzka | 239/585.4 X |
| 4,967,966 | 11/1990 | Babitzka et al. | 239/585.4 |
| 5,054,691 | 10/1991 | Huang et al. | 251/129.21 X |
| 5,373,992 | 12/1994 | Reiter | 239/585.4 |

FOREIGN PATENT DOCUMENTS

| | | | |
|---|---|---|---|
| 40 08 675 | 9/1991 | Germany . | |
| 127935 | 5/1990 | Japan | 29/890.124 |

*Primary Examiner*—Andres Kashnukiw
*Assistant Examiner*—Robin O. Evans
*Attorney, Agent, or Firm*—Kenyon & Kenyon

[57] ABSTRACT

A fuel injector including a valve needle, where individual components, such as the valve needle segment and the valve closing element, are rigidly connected with one another by means of using a joining method which does not act on substance. In ideal manner, only pressure connections are present on the valve needle.

11 Claims, 3 Drawing Sheets

FUEL INJECTOR

FIELD OF THE INVENTION

The present invention relates to a fuel injector.

BACKGROUND INFORMATION

German Patent Application No. 40 08 675 describes a conventional fuel injector including a valve needle, which in turn consists of an armature, a valve closing element, and a sleeve-shaped or tube-shaped connecting tube which connects the armature with the valve closing element, which can be spherical, for example. The parts listed represent individual parts which are manufactured separately, and which must be connected by means of joining methods which act on their substance, for example by means of laser-welding. Therefore there are at least two joints which result from the use of such joining methods. Because of the high thermal stress which occurs during methods such as welding or soldering, undesirable deformation of the valve needle can occur. The armature surrounds the connecting tube completely in the radial direction, and at least partially in the axial direction, since the connecting tube is attached in a lengthwise continuous aperture in the armature. The connecting tube itself also has an inner lengthwise continuous aperture, in which the fuel can flow in the direction of the valve closing element, and then exit close to the valve closing element, through crosswise apertures which are made in the wall of the connecting tube, and run radially.

SUMMARY OF THE INVENTION

The fuel injector according to the present invention, is advantageous in that a valve needle for the injector can be produced in particularly advantageous and cost-effective manner, with very simple and reliable connections of individual valve needle components, without the consequences of thermal stress. This is achieved, according to the present invention, by providing a rigid connection of the components which form the valve needle, such as the valve closing element and the valve needle segment, is obtained as a connecting part between the armature and the valve closing element, by using a joining method which does not act on their substance. Joining methods which are particularly suitable for this are, in particular, conventional methods such as pressing or impressing, clamping or squeezing. It is further advantageous that a secure and reliable connection of the two components of the valve needle is achieved, without the occurrence of undesirable deformation of the valve needle, as it can occur, in particular, in joining methods which act on substance, such as welding or soldering, because of the great thermal stress. A cost reduction is achieved in that the tolerances of the components can be comparatively great, since good compensation of deviations is made possible by the joining methods, because of the precise adjustment of process parameters. In addition, very high productivity can be achieved in the production of the valve needles, since production can be automated very well.

It is also advantageous to provide a cylindrical depression in the valve closing element, into which the sleeve-shaped valve needle segment is introduced. A brace element is pushed into the valve needle segment, which element is at least partly surrounded by the valve closing element. The actual pressing process, i.e., the production of the rigid connection between the valve needle segment and the valve closing element, does not take place until after the brace element has been inserted. Using a tool which can be moved into the inside channel of the valve needle segment, a pressure force which acts axially is applied to the brace element. It is particularly advantageous if a depression (indentation) is already provided on the tool engagement side of the brace element, so that slippage of the tool is precluded and the force effect acts in targeted manner. The material of the brace element is then plastically deformed in such a way that because of the good surface pressure, an optimum connection between the valve needle segment and the valve closing element is formed.

It is also advantageous to form a cylinder segment on the valve closing element, where the sleeve-shaped valve needle segment is pushed onto the cylinder segment of the valve closing element. A ring element surrounds the valve needle segment in the region of the cylinder segment, and a pressing tool acts on this ring, in order to achieve a rigid connection between the valve needle segment and the valve closing element.

Joining methods which do not act on substance are also a good possibility for connecting the sleeve-shaped valve needle segment with a tube-shaped armature. It is particularly simple and cost-effective if the valve needle segment is pressed or impressed into an inner lengthwise aperture of the armature, or onto the outside circumference of the armature. It is advantageous, in this connection, if the armature is structured with steps on the inside or outside, so that the steps each serve as stops for a valve needle segment to be pressed into or onto the armature.

DETAILED DESCRIPTION OF THE INVENTION

Figure 1:
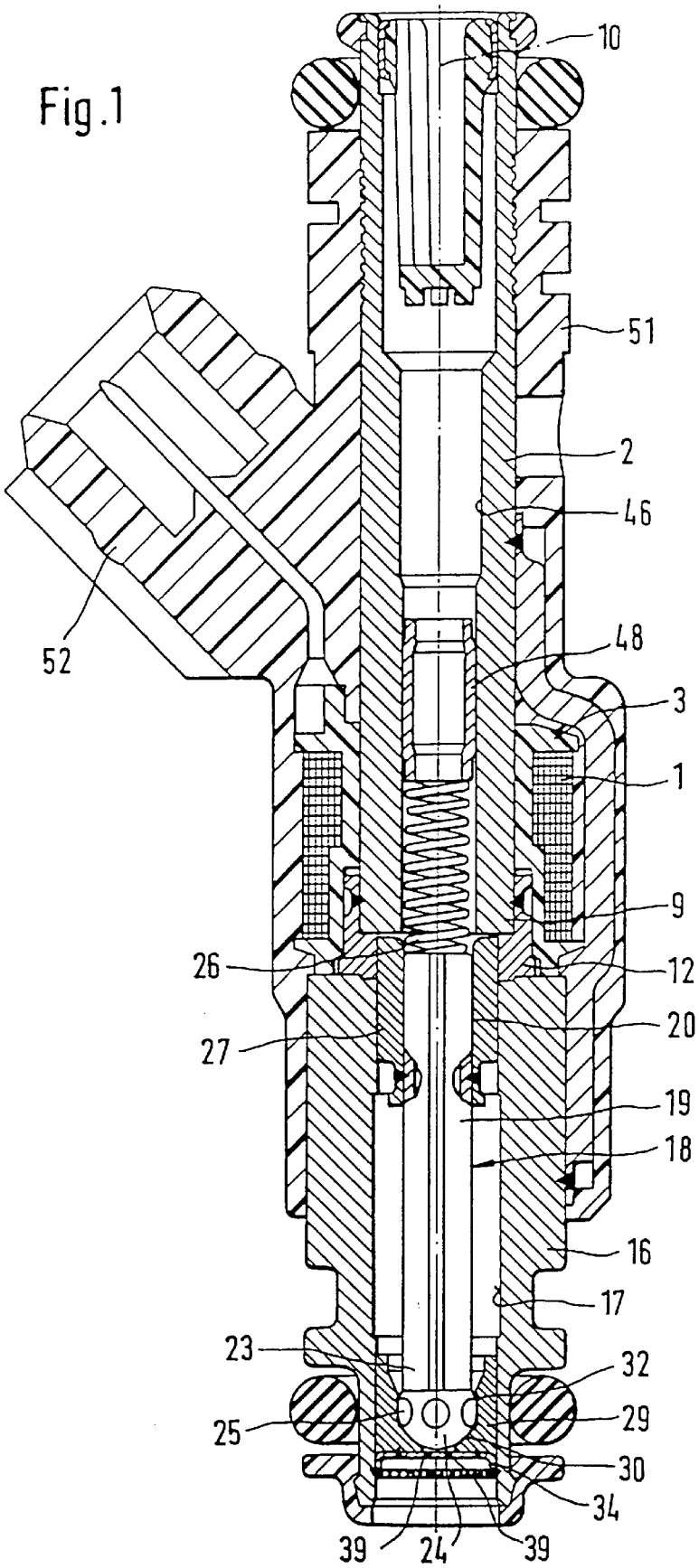
FIG. 1 shows a fuel injector with a valve needle according to the present invention.

The fuel injector for fuel injection systems of mixture-compressing, outside-ignition internal combustion engines, as shown in FIG. 1, for example, has a tube-shaped core 2 which serves as a fuel inlet tap and is surrounded by a magnetic coil 1, which core has a constant outside diameter over its entire length, for example. A coil element 3 which is stepped in the radial direction holds a winding of the magnetic coil 1, and, in combination with the core 2, allows a compact structure of the fuel injector in the region of the magnetic coil 1.

A tube-shaped, metal intermediate part 12 is tightly connected with a bottom core end 9 of the core 2, concentric to a longitudinal valve axis 10, for example by means of welding, and it partly surrounds the core end 9 axially. A tube-shaped valve seat carrier 16, which is rigidly connected with the intermediate part 12, for example, extends downstream from the coil element 3 and the intermediate part 12. A lengthwise bore 17, which is structured to be concentric to the longitudinal valve axis 10, runs through the valve seat carrier 16. A valve needle 18 with a sleeve-shaped or tube-shaped valve needle segment 19 is provided in the lengthwise bore 17. At the downstream end 23 of the valve needle segment 19, a valve closing element 24 is provided, which has an essentially spherical contour, for example, and on the circumference of which five flattened areas 25, for example, are provided to allow fuel to flow by. In this connection, the valve closing element 24, which is spherical, for example, is rigidly connected with the tube-shaped valve needle segment 19 of using a joining method which does not act on substance.

Activation of the injector takes place in known a conventional, e.g. electromechanically. The electromagnetic circuit with the magnetic coil 1, the core 2, and an armature 27 is used for axial movement of the valve needle 18 and therefore for opening the injector against the spring force of a return spring 26, or closing the injector. The armature 27, which is tube-shaped, for example, is rigidly connected with an end 20, positioned opposite to the valve closing element 24, of the valve needle segment 19, which is inserted into the armature 27 in the first exemplary embodiment according to the present invention, using a weld seam, and aligned on the core 2. The valve needle segment 19 which connects the armature 27, with the valve closing element 24 forms the valve needle 18.

A cylinder-shaped valve seat element 29, which has a fixed valve seat 30, is tightly mounted in the lengthwise bore 17, in the end of the valve seat carrier 16 which lies downstream front and faces away from the core 2, using a welding method. A guide aperture 32 of the valve seat element 29 serves to guide the valve closing element 24 during the axial movement of the valve needle 18 along the longitudinal valve axis 10. The valve closing element 24 interacts with the valve seat 30 of the valve seat element 29, which narrows to a truncated cone in the flow direction. At its frontal end which faces away from the valve closing element 24, the valve seat element 29 is rigidly and tightly connected with an injection hole disk 34, for example structured in pot shape, using a weld seam which is formed using a laser, for example. In the injection hole disk 34, at least one (and possibly four injection apertures 39), are provided, formed using erosion and/or punching methods.

The insertion depth of the valve seat element 29 with the injection hole disk 34 determines the height of the stroke of the valve needle 18. The one end position of the valve needle 18, when the magnetic coil 1 is not excited, is determined by the contact position of the valve closing element 24 on the valve seat 30 of the valve seat element 29, while the other end position of the valve needle 18, when the magnetic coil 1 is excited, results from the contact position of the armature 27 on the core end 9.

An adjustment sleeve 48, which is pushed into a flow bore 46 of the core 2 and which runs concentric to the longitudinal valve axis 10, serves to adjust the spring pre-tension of the return spring 26 which rests against the adjustment sleeve 48, the spring 26 resting against the valve needle segment 19 at its opposite end. The injector is essentially surrounded by a plastic extrusion coating 51, which extends from the core 2 over the magnetic coil 1 to the valve seat carrier 16, in the axial direction. Part of this extrusion coating 51 is, for example, an electric connection plug 52, which is also extruded on.

Figure 2:
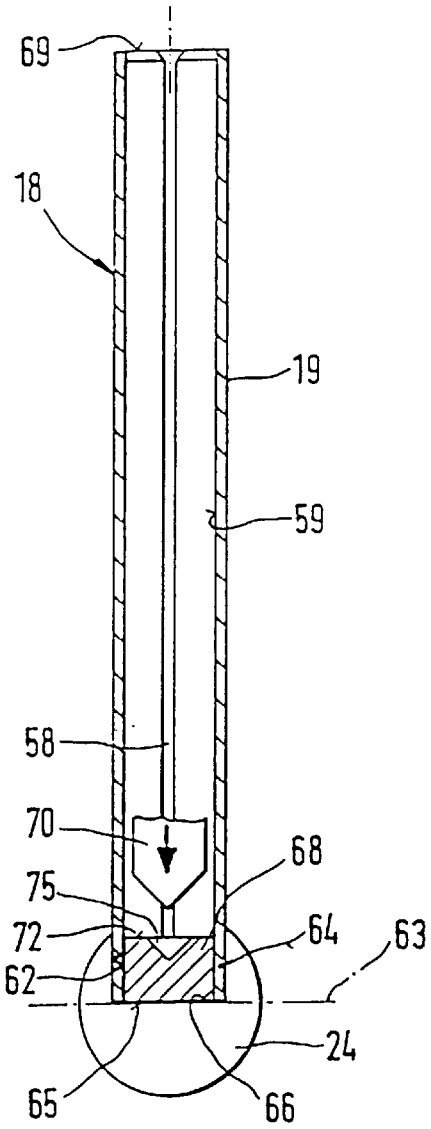
FIG. 2 shows a first type of connection between two components of a valve needle according to the present invention for illustrating possibilities of connecting spherical valve closing elements and sleeve-shaped valve needle segments.

FIG. 2 shows a valve needle 18 as a single component, in an enlarged view, where only the tube-shaped valve needle segment 19 and the valve closing element 24 are shown, and the armature 27 is not shown. The rigid connection between the valve needle segment 19 and the valve closing element 24, according to the present invention, which does not act on substance, is further described as follows. A slit 58 which penetrates radially through the tube wall is provided in the tube wall of the valve needle segment 19; this slit extends, for example, over the entire length of the valve needle segment 19, and fuel which flows from the armature 27 into an inside channel 59 of the valve needle segment 19 can get into the lengthwise bore 17 and from there to the valve seat 30. Finally, such a fuel flow in the injector is guaranteed in this way up to the at least one injection aperture 39, so that the fuel is injected into an intake tube or a cylinder of an internal combustion engine. The slit 58 represents a hydraulic flow cross-section with a large area, via which the fuel can flow very rapidly out of the inside channel 59 into the lengthwise bore 17 and to the valve seat 30. In addition to the slit 58, other flow apertures, for example circular apertures, can also be provided in the valve needle segment 19, which then distribute the fuel more uniformly over the circumference. Production of the valve needle segment 19 from a section of sheet metal is a particularly easy and simple method of production, which also makes it possible to use many different kinds of materials. By providing the slit 58 in the valve needle segment 19, this part is resilient, so that relatively large tolerances can be selected for the inner aperture of the armature 27, the valve needle segment 19 itself, and also the valve closing element 24, since because of the resilient flexibility, the valve needle segment 19 can be pushed into the other components with its two ends under tension, in each instance, which also makes assembly easier.

For the valve needle 18 according to the present invention, the rigid connection of the valve needle segment 19 and the valve closing element 24, produced using a joining method which acts on substance (e.g. welding), is to be replaced with a connection formed using the joining methods which do not act on substance, such as pressing, clamping, or squeezing methods. In a first exemplary embodiment shown in FIG. 2, a depression 62 is produced in the valve closing element 24, from one side of the circumference, the depression 62 having has a cylindrical shape and a diameter which approximately corresponds to the diameter of the tube-shaped valve needle segment 19. Drilling, milling, erosion or grinding methods are possible production methods for generating the depression 62. In the case of a spherical valve needle segment 24, the depression 62 extends, for example, to the center point of the sphere, i.e. to the plane of a sphere equator 63, which is identified with a dot-dash line.

Subsequently, the valve needle segment 19 is pushed into the depression 62 with its one end segment 64, where it is possible, because of the slit 58 and the resilience which it produces, to slightly reduce the diameter of the valve needle segment 19 by slightly pressing it together, and thereby facilitate insertion. The valve needle segment 19 can then be released again, and presses against the inside side wall of the depression 62 because of the resilience effect, while an end surface 65 of the valve needle segment 19 contacts on a depression bottom 66 of the depression 62, for example. To ensure that all strength requirements are met, and that the desired connection is maintained, an additional cylindrical brace element 68 made of an easily deformable material (e.g. soft metal) is introduced into the valve needle segment 19 from a frontal end 69 which lies opposite its end surface 65. The cylindrical brace element 68 has a slightly smaller diameter than the inside channel 59 of the valve needle segment 19. This allows the brace element 68 to slide along in the inside channel 59, until it reaches the depression 62 of the valve needle segment 24, where it also rests on the depression bottom 66, for example. The actual pressing process, i.e. the production of the rigid connection between the valve needle segment 19 and the valve closing element 24, only takes place after insertion of the brace element 68. Using a tool 70 which can be axially introduced into the inside channel 59, e.g. in the form of a pressure punch, a pressure force with an axial effect is applied to the brace element 68, at its side 72 which faces away from the end surface 65. At the top side 72 of the brace element 68, a depression 75 (pre-punched) can already be provided, in order to allow a better engagement of the tool 70; this depression can be centrally arranged, for example, and have a spherical contour. The depression 75 in the brace element 68 can also be trough-shaped, funnel-shaped, crater-shaped, groove-shaped or have a different shape.

As a result of the pressure force which acts axially, the brace element 68 is plastically deformed in such a way that the material which escapes radially outward presses the end segment 64 of the valve needle segment 19 hard against the contact surface between the valve closing element 24 and the valve needle segment 19. Because of the plastic deformation of the brace element 68, very good surface pressure and a corresponding optimum connection are achieved. It is also possible to use an element with a different shape, instead of the cylindrical brace element 68, for the pressing process. By exerting force on a sphere, a disk, or a cone as brace elements 68 (not shown in FIG. 2), a rigid connection between the valve closing element 24 and the valve needle segment 19 can also be achieved.

Figure 3:
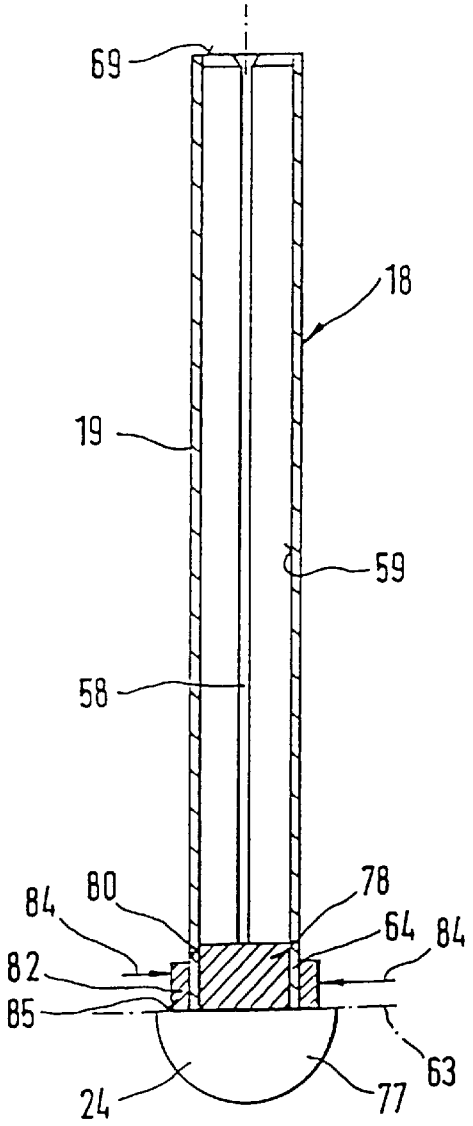
FIG. 3 shows a second type of connection between two components of a valve needle according to the present invention for illustrating possibilities of connecting spherical valve closing elements and sleeve-shaped valve needle segments.

Another exemplary embodiment of a valve needle 18 with a connection between the valve closing element 24 and the valve needle segment 19 which does not act on substance is shown in FIG. 3. In this embodiment, the valve closing element 24, which is spherical, for example, is finished on one side in such a way that there is no longer a spherical contour in this region. This finishing takes place, for example, on only one half of the sphere, so that the spherical shape is retained on the other side of the sphere, proceeding from the sphere equator 63, specifically as a spheroid segment 77, in the concrete case as a hemispherical segment. This spheroid segment 77 of the valve closing element 24 interacts accordingly with the valve seat 30. In this connection, it is that this segment 77 which interacts with the valve seat 30 represents exactly a hemisphere, as shown in FIG. 3; it can also be larger or smaller. On the side opposite the spheroid segment 77, the contour is formed, for example by lathing, grinding or erosion, in such a way that a cylinder segment 78 which extends out of the spheroid segment 77 is formed.

This cylinder segment 78 has approximately the same diameter as the inside channel 59 of the valve needle segment 19, so that the valve needle segment 19 can very easily be pushed onto the cylinder segment 78 with its one end segment 64. For this purpose, the end segment 64 of the valve needle segment 19 can also be slightly expanded, for example. Because of its resilience, the valve needle segment 19 already presses against the outer mantle side 80 of the enclosed cylinder segment 78, after it is pushed on. A rigid connection between the valve closing element 24 and the valve needle segment 19 is achieved in that a ring element 82 is pushed and/or pressed onto the valve needle segment 19 at its end segment 64. The ring element 82 can be structured as a closed element or with a slit. A pressing tool 84 is merely indicated with arrows, with a radial force effect mainly being present. The ring element 82 and the valve needle segment 19 are resting, for example, on a top delimitation surface 85 of the spheroid segment 77, which is located in the plane of the sphere equator 63, for example. In FIGS. 1 to 3, a spherical valve closing element 24 is shown, in each instance. However, the valve closing element 24 can also have any other shape, and can therefore be structured in conical, cylindrical, or a different shape.

Figure 4:
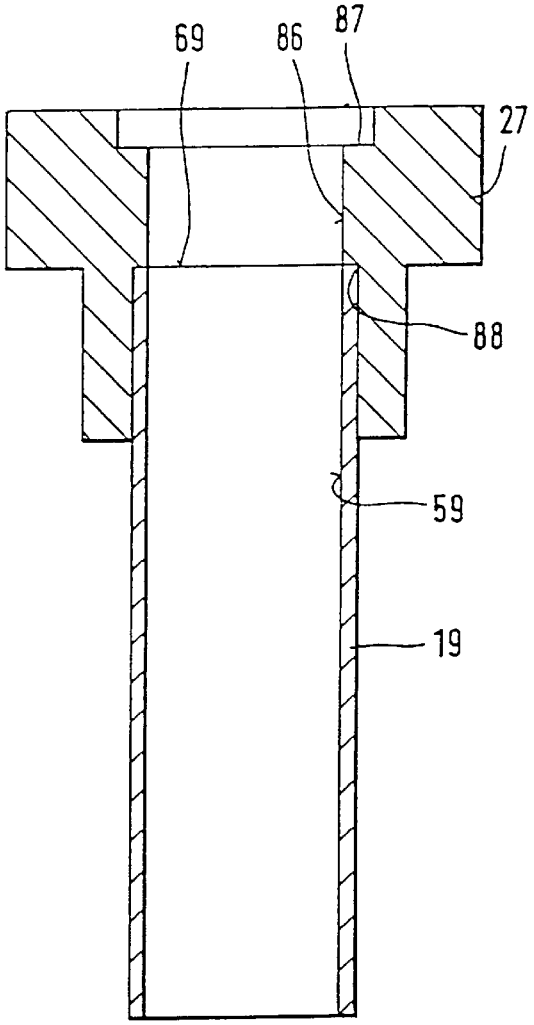
FIG. 4 shows a third type of connection between two components of a valve needle according to the present invention for illustrating possibilities of connecting sleeve-shaped valve needle segments and tube-shaped armatures.
Figure 5:
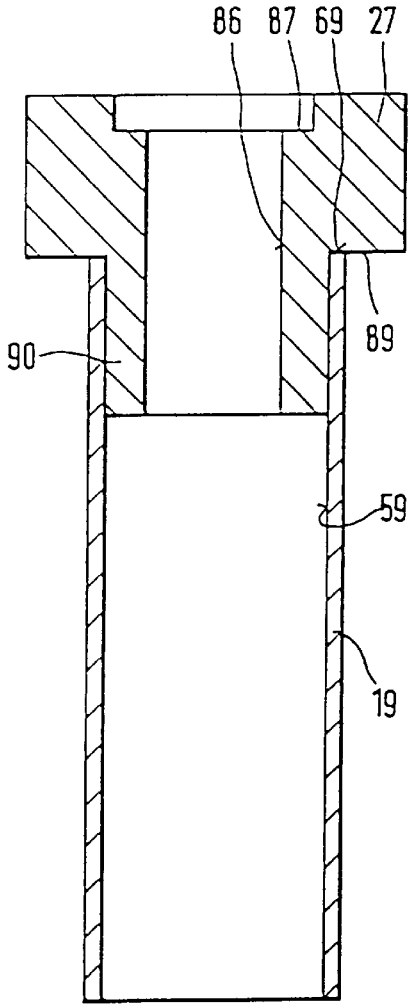
FIG. 5 shows a fourth type of connection between two components of a valve needle according to the present invention for illustrating possibilities of connecting sleeve-shaped valve needle segments and tube-shaped armatures.

FIGS. 4 and 5 show two exemplary embodiments of valve needles 18, in which only the sleeve-shaped valve needle segment 19 and an armature 27 attached to it can be seen, in each instance, and the valve closing element 24 to be attached at the end of the valve needle segment 19 opposite the armature 27 is not shown. The valve closing elements 24 can be connected with the valve needle segment 19, among other things, in accordance with the exemplary embodiments shown in FIGS. 2 and 3. However, FIGS. 4 and 5 are intended to show that joining methods which do not act on substance can also be used for the production of a rigid connection between the valve needle segment and the armature 27. It is particularly advantageous if the armature 27 is structured in stepped shape. The tube-like armature 27 has an inner lengthwise aperture 86, which extends over the entire length of the armature 27, in order to ensure fuel feed in the direction towards the valve needle segment 24, among other things. A top setback 87 in the lengthwise aperture 86 serves as a contact point for the return spring 26, for example.

In the exemplary embodiment shown in FIG. 4, the lengthwise aperture 86 has another step 88, in addition to the setback 87, which lies downstream and by means of which the cross-section of the lengthwise aperture 86 widens, viewed in the flow direction. The size of this step 88 is selected in such a way, for example, that the tube-shaped valve needle segment 19 reaches into the inner lengthwise aperture 86 of the armature 27, namely so far that the valve needle segment 19 rests against the step 88 with its top frontal end 69, and the diameter of the lengthwise aperture 86, above the step 88, corresponds to the diameter of the inside channel 59 of the valve needle segment 19. The valve needle segment 19 is pressed into the lengthwise opening 86, i.e. there is a press fit between the armature 27 and the valve needle segment 19, which is selected to be light so that a secure and reliable connection is guaranteed, even in continuous use in an injector of an internal combustion engine, and with the corresponding vibrations which occur. The valve needle segment 19 can have a knurled edge in its top region, for example, which is surrounded by the armature 27, which makes it possible to select wider (greater) tolerances for the fit. Pressure connections are based on the friction between the connection partners which result from surface pressure, which is brought about by deformation due to an excess dimension of the two components relative to one another. The non-positive connection can therefore absorb the tensile forces which act on the valve needle 18 when the injector is opened, without any problems.

In the second exemplary embodiment of a pressure connection between the valve needle segment 19 and the armature 27, shown in FIG. 5, the sleeve-shaped valve needle segment 19 is pressed onto the outside contour of the armature 27. The outside contour of the armature 27 proceeds in steps, for example, where an outer step 89, for example, is provided approximately in the middle of the axial expanse of the armature 27. Viewed in the flow direction, a reduction in the outside diameter of the armature 27 takes place by means of the step 89. The inner lengthwise aperture 86 in the armature 27 now proceeds at a constant diameter, with the exception of the top setback 87 for the return spring 26. The valve needle segment 19 is pressed onto a bottom armature segment 90, which has a reduced outside diameter, in such a way that the valve needle segment 19 rests against the step 89 with its top front face 69. The inside channel 59 of the valve needle segment 19 has approximately the same diameter, downstream from the armature 27, as the outside diameter of the bottom armature segment 90. The description above with regard to pressing or impressing apply analogously here.

What is claimed is:

1. A fuel injector, comprising:

a magnetic coil;

a core surrounded by the magnetic coil;

an armature facing the core;

a fixed valve seat;

a valve closing element; and a sleeve-shaped valve needle segment positioned substantially between the armature and the valve closing element, the valve needle segment being rigidly connected to the armature and to the valve closing element for forming a valve needle that interacts with the fixed valve seat, the valve needle segment being rigidly connected to the valve closing element using a joining technique without acting on respective substances of the valve needle segment and the valve closing element to maintain the valve closing element in a fixed position relative to the valve needle segment throughout an opening operation and a closing operation of the fuel injector.

2. The fuel injector according to claim 1, wherein the valve closing element includes a cylinder segment extending into an inner channel of an end segment of the valve needle segment, the end segment being pressed to receive a ring element.

3. The fuel injector according to claim 2, wherein the valve closing element includes a hemispherical spheroid segment having a sphere equator, and wherein hemispherical spheroid segment couples to the cylinder segment at the sphere equator.

4. The fuel injector according to claim 1, wherein the valve needle segment is at least partially pressed into a lengthwise opening of the armature.

5. The fuel injector according to claim 1, wherein the armature includes a further segment, and wherein the valve needle segment is at least partially pressed onto an outside contour of the further segment.

6. A fuel injector, comprising:

a magnetic coil;

a core surrounded by the magnetic coil;

an armature facing the core;

a fixed valve seat;

a valve closing element; and a sleeve-shaped valve needle segment positioned substantially between the armature and the valve closing element, the valve needle segment being rigidly connected to the armature and to the valve closing element for forming a valve needle that interacts with the fixed valve seat, the valve needle segment being rigidly connected to the valve closing element using a joining technique without acting on respective substances of the valve needle segment and the valve closing element, wherein the valve closing element includes a depression substantially positioned at a circumference of the valve closing element, the valve needle segment having a first end segment for extending into the depression, and wherein the valve needle segment includes a continuous inner channel extending in a lengthwise direction, the continuous inner channel accommodating a brace element, the brace element being at least partially surrounded by the valve closing element.

7. The fuel injector according to claim 6, wherein the depression has a cylindrical shape and includes a depression bottom for resting the valve needle segment and the brace element thereon.

8. The fuel injector according to claim 7, wherein the valve closing element has a spherical shape, and wherein the depression bottom extends through a center point of the spherically-shaped valve closing element, the depression bottom extending in the plane of a sphere equator of the valve closing element.

9. The fuel injector according to claim 6, wherein the brace element has a cylindrical shape, the brace element further having a slightly smaller external diameter than an inner channel diameter of the inner channel before the valve needle segment is rigidly connected to the valve closing element.

10. The fuel injector according to claim 7, wherein the brace element includes a top side extending away from the depression of the valve closing element, and wherein the top side includes a further depression for engaging with a tool for rigidly connecting the valve needle segment to the valve closing element.

11. A fuel injector, comprising:

a magnetic coil;

a core surrounded by the magnetic coil;

an armature facing the core;

a fixed valve seat;

a valve closing element;

a sleeve-shaped valve needle segment positioned substantially between the armature and the valve closing element, the valve needle segment being rigidly connected to the armature and to the valve closing element for forming a valve needle that interacts with the fixed valve seat, the valve needle segment being rigidly connected to the valve closing element using a joining technique without acting on respective substances of the valve needle segment and the valve closing element; and a ring element surrounding an end segment of the valve needle segment, the ring element being one of closed and slitted.

* * * * *

UNITED STATES PATENT AND TRADEMARK OFFICE

CERTIFICATE OF CORRECTION

PATENT No. : 5,875,975

DATED : March 2, 1999

INVENTOR(S): Reiter et al.

It is certified that error appears in the above-identified patent and that said Letters Patent is hereby corrected as shown below:

Col. 3, line 15, after "19" delete "of";

Col. 3, line 17, delete "known" and after "conventional" add -- manner --;

Col. 3, line 29, after "27" delete "," comma;

Col. 4, line 62, delete "on";

Col. 5, line 49, change "it is that this" to -- it is not required that this --;

Col. 6, line 11, change "or a different shape" to -- or another conceivable shape --;

Col. 6, line 46, change "light" to -- tight --.

Signed and Sealed this

Fifteenth Day of February, 2000

*Attest:*

Q. TODD DICKINSON

*Attesting Officer*

*Commissioner of Patents and Trademarks*